US008413921B2

(12) United States Patent
Umemura

(10) Patent No.: US 8,413,921 B2
(45) Date of Patent: Apr. 9, 2013

(54) SUPPORTING MECHANISM FOR A LONG MATERIAL A SUPPORTING UNIT USING THIS MECHANISM, AND A METHOD FOR PREVENTING SWING OF A LONG PIECE OF MATERIAL

(75) Inventor: Mitugi Umemura, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 0 days.

(21) Appl. No.: 12/310,882

(22) PCT Filed: Aug. 30, 2007

(86) PCT No.: PCT/JP2007/066864

§ 371 (c)(1),
(2), (4) Date: Mar. 11, 2009

(87) PCT Pub. No.: WO2008/032582

PCT Pub. Date: Mar. 20, 2008

(65) Prior Publication Data

US 2011/0042544 A1 Feb. 24, 2011

(30) Foreign Application Priority Data

Sep. 13, 2006 (JP) ..... 2006-247870
Jul. 9, 2007 (JP) ..... 2007-179145

(51) Int. Cl.
*B65H 57/14* (2006.01)

(52) U.S. Cl.
USPC ..... 242/615.2; 226/196.1; 242/615.3

(58) Field of Classification Search ..... 242/615.1, 242/615.2, 615.3, 377, 397, 566, 152.1, 157 R, 242/171, 419.5; 226/1, 168, 196.1, 195; 254/389; 248/55; 279/22, 75
See application file for complete search history.

(56) References Cited

U.S. PATENT DOCUMENTS

| | | | | | |
|---|---|---|---|---|---|
| 180,961 | A | * | 8/1876 | Thackara et al. | 248/337 |
| 751,345 | A | * | 2/1904 | Saunders | 279/28 |
| 1,548,730 | A | * | 8/1925 | Mirfield | 409/66 |
| 1,754,132 | A | * | 4/1930 | Van Bekkum | 254/384 |
| 1,954,999 | A | * | 4/1934 | Hopkins | 314/129 |
| 1,984,389 | A | * | 12/1934 | Wineman | 192/58.1 |
| 2,082,364 | A | * | 6/1937 | Store | 324/694 |

(Continued)

FOREIGN PATENT DOCUMENTS

| | | |
|---|---|---|
| JP | 54-40981 | 3/1979 |
| JP | 59-136203 | 11/1984 |

(Continued)

*Primary Examiner* — Michael Mansen
*Assistant Examiner* — Scott Haugland
(74) *Attorney, Agent, or Firm* — Finnegan, Henderson, Farabow, Garrett & Dunner, L.L.P.

(57) ABSTRACT

A supporting mechanism is provided that prevents swings and deflections of a long piece of material, as well as eliminates any scratches of it that may arise when it is being processed. The supporting mechanism includes a group of spherical bodies C, four pieces of movable supporting members 1, and coil springs 2. The group of spherical bodies C comprises a first group of spherical bodies C1. The movable supporting members 1 are provided around the second group of spherical bodies C2, contacting the periphery of the group. The coil springs 2 are a biasing device that pushes the movable supporting members 1 toward the central axis of the long piece of material W.

6 Claims, 3 Drawing Sheets

U.S. PATENT DOCUMENTS

| | | | | | |
|---|---|---|---|---|---|
| 2,286,140 | A | * | 6/1942 | Klein et al. | 242/157 R |
| 2,694,130 | A | * | 11/1954 | Howard | 219/137.44 |
| 2,762,330 | A | * | 9/1956 | Whitehead | 118/33 |
| 3,271,835 | A | * | 9/1966 | Hadley | 26/15 R |
| 3,975,032 | A | * | 8/1976 | Bent et al. | 279/30 |
| 4,047,709 | A | * | 9/1977 | Thyberg et al. | 269/22 |
| 4,353,537 | A | * | 10/1982 | Koufos | 269/266 |
| 4,516,446 | A | * | 5/1985 | Flohn | 82/163 |
| 4,752,063 | A | * | 6/1988 | Nagy | 269/266 |
| 4,850,154 | A | | 7/1989 | Grammer et al. | |

FOREIGN PATENT DOCUMENTS

| | | | |
|---|---|---|---|
| JP | 63-22205 | A | 1/1988 |
| JP | 05-162009 | | 6/1992 |
| JP | 09-262708 | A | 10/1997 |

* cited by examiner

SUPPORTING MECHANISM FOR A LONG MATERIAL A SUPPORTING UNIT USING THIS MECHANISM, AND A METHOD FOR PREVENTING SWING OF A LONG PIECE OF MATERIAL

FIELD OF INVENTION

The present invention relates to a supporting mechanism for a long piece of material and a supporting unit using this supporting mechanism. More particularly, it relates to a supporting mechanism for a long piece of material and a supporting unit using this mechanism that together prevent swings and deflections of the long piece of material that are generated while the material is fed by or pulled out from a wire-feeding device, for example.

Further, the present invention relates to a method for preventing swings and deflections of the long piece of material using this supporting unit.

BACKGROUND OF THE INVENTION

For example, a shot-blasting device polishes a wire by throwing shot-blasting media against it, where the wire is a long piece of material being pulled and tensioned. This shot-blasting device comprises a wire-feeding device, a device for throwing shot-blasting media, and a device for winding a wire. The wire-feeding device, which is provided on one side of a polishing chamber, through which side the wire enters, causes a wire that has been wound in a coil to run in almost a straight line, and feeds it into the chamber. The device for throwing the media, which is installed inside the polishing chamber, throws them at the wire that is coming from the wire-feeding device and running through the chamber. The device for winding a wire, which is provided on the side of the polishing chamber from which the wire comes out, reels in the wire that has been processed by the shot-blasting. The shot-blasting device has guiding equipment so as to prevent the wire from any swinging that could be caused by shot-blasting media throwing shot against the wire.

There are many kinds of guiding equipment using various mechanisms. For example, an ancillary jig for preventing swings comprising a hollow cylinder, a plurality of balls, and a cap, may be used as guiding equipment (see the Publication of Examined Utility Model No. 63-2241). The hollow cylinder has a through-hole, and a convex conic surface is formed on one end of the cylinder. Two or more V-shaped grooves are made on the conic surface toward its central axis. In each groove a ball is inserted so that a part of it can protrude through the through-hole. The cap, which is axially screwed in one end of the cylinder, keeps these balls on the conic surface by a concave conic surface.

However, before being put in the wire-feeding device, such a wire that is wound in a coil has a plurality of crooked parts. They are locally made from straps for binding coils when they are transported from their manufacturer, for example. Even though the wire feeding device tries to make the wire in a straight line, it is very difficult to completely remedy the crooked parts and do so. If the wire having these crooked parts were to pass through the guiding equipment at a velocity of 5-150 m/min, it might be scratched by the protruding parts of the balls and damaged, because there is no radial play between the wire and the balls.

The present invention was conceived so as to resolve the above problem. Its purpose is to provide a supporting mechanism that decreases the swings and deflections of a long piece of material that arise when the material is processed, as well to prevent scratches of the material. Also, it is to provide a supporting unit using this mechanism and to provide a method for preventing swings and deflections of the long piece of material using this unit.

SUMMARY OF THE INVENTION

The supporting mechanism of material of the present invention is one that supports a long piece of material. It comprises a group of spherical bodies that is provided around the central axis of the long piece of material, a plurality of movable supporting members that are provided around the group of spherical bodies, and which contact the periphery of the group, and biasing means that push the movable supporting members toward the central axis of the long piece of material.

Also, the supporting unit for a long piece of material of the present invention comprises a casing that has an entrance for inserting the long piece of material and an exit. The supporting mechanism is installed inside this casing.

Further, the method for preventing swings of a long piece of material of the present invention is to prevent swings of it by installing the supporting unit at a given place in a processing chamber of a device for processing.

By the supporting mechanism of the present invention, a group of rolling spherical bodies is held by movable supporting members and biasing means. They can roll and move toward the central axis of the long piece of material. Accordingly, even if a long piece of material has, say, a concave-convex surface, crooked parts, or waves, the supporting mechanism will cause the long piece of material to pass through it, it will be able to suppress the swings and deflections of the long piece of material that arise while it is being processed, and it will be able to prevent scratches of it.

Also, the supporting unit of the present invention has openings on the movable supporting member of the supporting mechanism and on the unit itself. Accordingly, even if dust from shot or scale (fouling) that is generated during heat treatment gets into the supporting mechanism, it will be discharged through the openings and the dust and the scale will not enter the supporting unit. Thus scratches of the long piece of material will be prevented.

Further, supplying a gas such as compressed air toward the supporting mechanism in the supporting unit can keep the inside of the mechanism clean.

Also, installing the supporting unit at the given place in a processing chamber for a device for processing can suppress the swings of a long piece of material and prevent scratches of it.

BRIEF DESCRIPTIONS OF THE DRAWINGS

DESCRIPTION OF THE PREFERRED EMBODIMENT

The present invention is a supporting mechanism for a long piece of material and a supporting unit using this mechanism. It can be used in a processing chamber of a device for processing that eliminates swings of the object to be processed. The supporting mechanism can restrict the swings and deflections of the long piece of material that arise while its surface is being processed, it is being chopped or cut, or it is running in the device. The device for processing may be, for example, a shot-blasting device, which polishes the surface of a long piece of material, or, for example, a cutting device, which cuts a long piece of material to a certain length, or, say, a trimming device, which cuts certain grooves at the end of a long piece of material, or, for example, a device for end-processing, which trims the surface of an end of a long piece of material, or, say, a straightening device, which straightens a long piece of material by getting it to go through a strainer, or, say, a carrier of a semifinished product such as a billet, a bloom, or a hoop strip, or a centerless polishing device, which trims a long piece of material using a roll brush and a regulating wheel, etc.

A long piece of material that is processed by the present invention may be a wire that has a diameter of 2-20 mm and has a cross-sectional shape of a circle, a rectangle, or a polygon, or a metallic pipe that has a cylindrical shape or rectangular shape. The long piece of material may be made of steel, copper, aluminum, a steel alloy, or like material.

Figure 1:
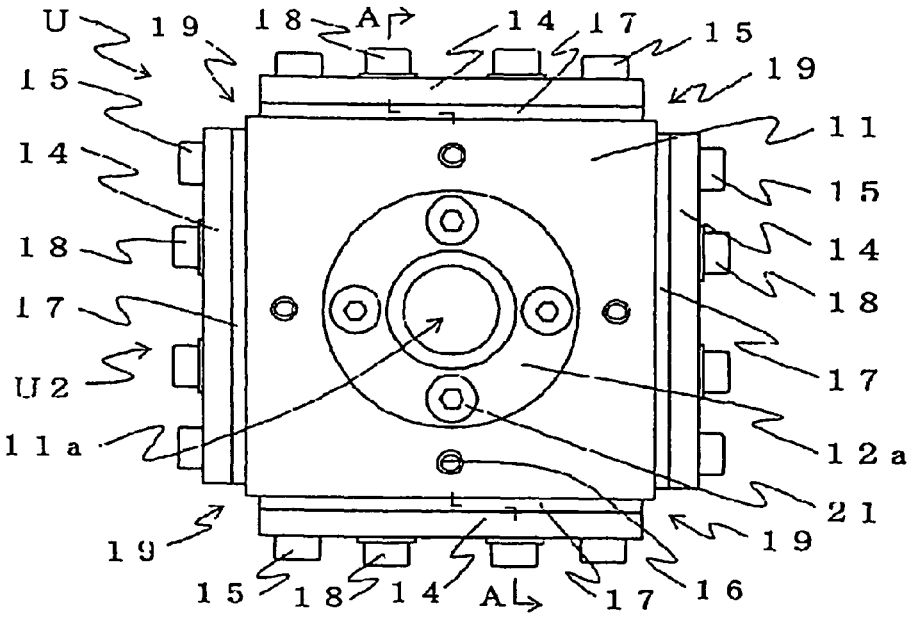
FIG. 1 is a front view of a supporting unit in which a supporting mechanism of the one embodiment of the present invention is incorporated.
Figure 2:
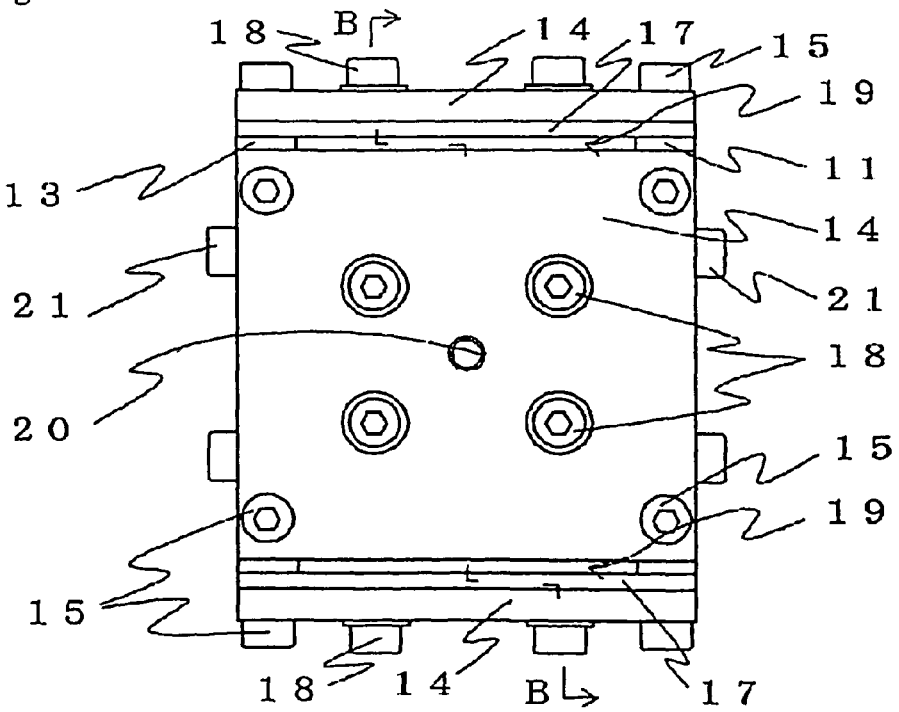
FIG. 2 is a left side view of the supporting unit of FIG. 1.

Below, we discuss a supporting mechanism for a long piece of material and a supporting unit for it using the mechanism, by reference to the attached drawings. As in FIGS. 1-4, the supporting unit U, in which the supporting mechanism of one embodiment of the present invention is incorporated, comprises a supporting mechanism U1 and a casing U2 in which the mechanism U1 is installed. The supporting mechanism U1 comprises a group of spherical bodies C, four movable supporting members 1, and coil springs 2. The group of spherical bodies C comprises a first group of spherical bodies C1 that is provided around the central axis of the long piece of material W and a second group of spherical bodies C2 that is circumferentially provided around the first group of spherical bodies C1. The movable supporting members 1 are provided around the second group of spherical bodies C2, contacting the periphery of the group. The coil springs 2 are biasing means that push the movable supporting members 1 toward the central axis of the long piece of material W. The casing U2 comprises a member for the inserting side 11, a member for the outgoing side 13, four lateral members 14, and a plurality of bolts 15. The member for the inserting side 11 is rectangular. It has a die 12*a* that is installed at the entrance 11*a* for inserting the long piece of material W. The member for the outgoing side 13, which is placed on the opposite side of the member for the inserting side 11, is rectangular and has a die 12*b* installed at the exit 13*a* of the long piece of material W. The lateral members 14 are installed so as to enclose the space between the member for the inserting side 11 and the member for the outgoing side 13. The bolts 15 are used as an affixing means. They affix the member for the inserting side 11, the member for the outgoing side 13, and the lateral members 14. The number 16 in FIG. 1 denotes threaded holes that are used for affixing the supporting unit U to a device for processing.

Figure 3:
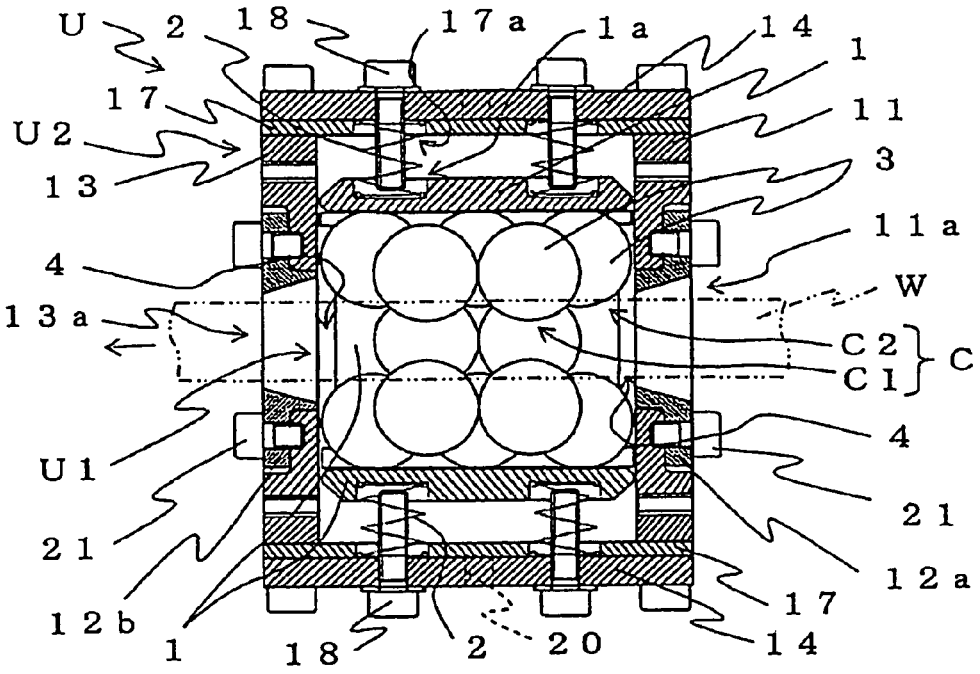
FIG. 3 is a sectional view of section A-A of FIG. 1.
Figure 4:
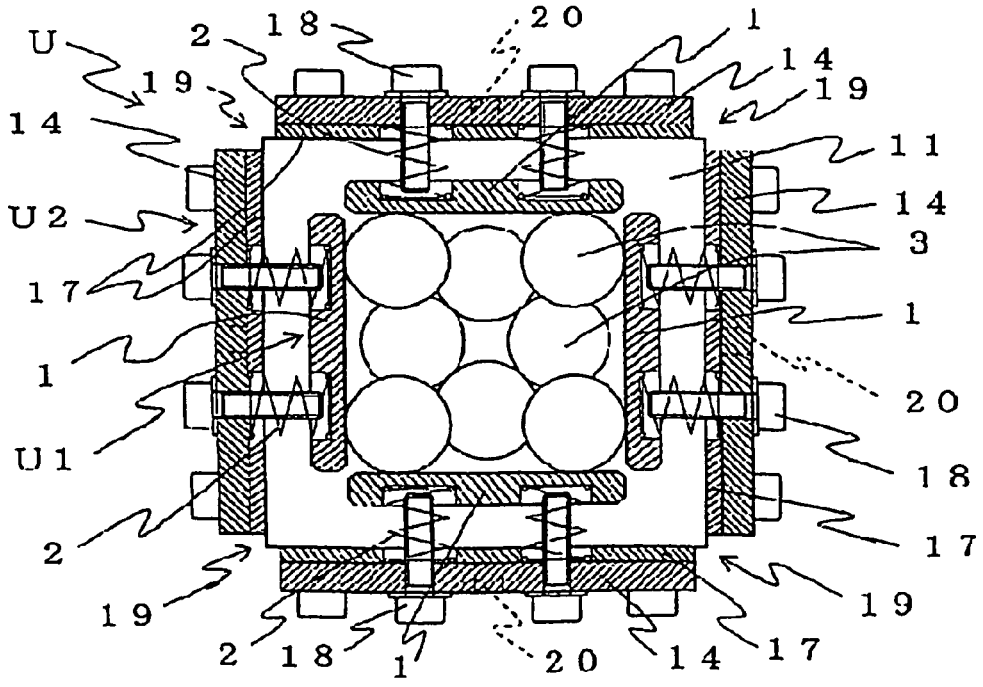
FIG. 4 is a sectional view of section B-B of FIG. 1.

The first group of spherical bodies C1, as in FIGS. 3 and 4, consists of eight balls that are arranged in two lines of four balls each in a longitudinal direction (i.e., the right and left sides, as in FIG. 3). The second group of spherical bodies C2 consists of twelve balls that have the same size as those of the first group, and that are arranged in three lines of four balls each in a longitudinal direction.

The numbers, allocations, and the diameters of the spherical bodies C1 and C2 of the first and second groups are not restricted as in this embodiment of the present invention. They can be chosen appropriately, because the spherical bodies should be allocated around the central axis of the long piece of material W, considering the diameter of the material W, the swings of it, the exciting force imparted to it, etc., for example, and because the distance (pitch) between the supporting points that support the long piece of material W should be adjusted by the spherical bodies 3 of the first group C1.

For example, the number of spherical bodies 3 of the first group C1 may depend on their diameter. For example, there can be three in one line, as long as the number is large enough not to have the spherical bodies become separated, i.e., as long as it is large enough to get them to be set on the central axis of the long piece of material W. Also, the number of spherical bodies 3 of the second group C2 may be chosen appropriately, i.e., in correlation with the number of spherical bodies 3 of the first group C1.

The arrangement of the spherical bodies C1 and C2 of the first and second groups may be chosen appropriately, such as by an arrangement of one line or three lines. In this embodiment, the group of spherical bodies C consists of two stages. But the present invention is not restricted to this. The group of spherical bodies may be added at one more stage by further piling a group of them on the first or second groups, depending on the swings of the long piece of materials W and the exciting force imparted to it, etc. Further, the allocations of the spherical bodies C1 and C2 of the first and second groups may be reversed.

In this embodiment, the diameters of the spherical bodies 3 of the first and second groups C1 and C2 are the same, but they may be different. For example, the diameter of the spherical bodies 3 of the first group C1 may be smaller than that of the second group C2, so that the pitch of the supporting points that support the long piece of material W by the bodies 3 of the first group C1 can be adjusted to be shorter.

The spherical bodies 3 are not restricted to ones having high sphericity. They should be such ones that will be able to roll in any direction. The material of them may be a refractory metal, a ceramic, a special alloy steel, a bearing steel, etc. The diameter of the spherical bodies 3 may be 4-25 mm, and their hardness may be HV 400-1400.

The movable supporting members 1 are rectangular plates. The back of the surface of the plate that contacts the second group of spherical bodies C2 has concave portions 1*a* that are mounted on one side of the coil springs 2. The inner surface of each lateral member 14 has a liner 17 so as to prevent wear caused by foreign materials that entered and passed through the dies 12*a* and 12*b* of the supporting mechanism U1, and through openings 4, to be described below. The liner 17 has openings 17*a* through which one side of each coil spring 2 is mounted on the lateral member 14. Providing the liner 17 is significantly effective, because the shot-blasting process, which polishes the surface of a long piece of material W, tends to have foreign materials enter the casing U2. The concave portions 1*a* and the openings 17*a* set the coil springs 2 on the appropriate places of the lateral member 14, and prevent the movement of them during the operation, since they are affixed to one side of the coil springs 2. In this embodiment, the places where the coil springs 2 are to be mounted are at the four corners of the supporting member 1 and the liner 17, so that each movable supporting member 1 is equally pressed by the four coil springs 2. Four coil springs 2 are used so that each movable supporting member 1 is equally urged. But one coil spring with a large bore diameter may be used, if it simultaneously presses the points at which the movable supporting member 1 contacts the spherical bodies 3 of the second group C2.

Bolts 18 are inserted from the lateral member 14 to the concave portions 1*a* as devices that restrict the movement of the movable supporting member 1. Since the bolts 18 are used as the restricting devices, the limit of the movement of the spherical bodies 3 may be predetermined. Also, by adjusting the length of the bolts 18 in the supporting unit U, the unit U may be adapted to correspond to the diameter of a long piece of material that will run through it.

The movable supporting members 1 have openings 4 at the extremities, except those at which the supporting members 1 are adjacent to each other, as in FIG. 3. Through those openings 4, so as to prevent dust and scale from affecting the supporting mechanism U1, the dust from shot that entered the supporting mechanism U1 while the surface of the long piece of material W that is running through the mechanism U1 is being polished by shot-blasting will be discharged. Also, through the openings 4, scale that comes off the long piece of material W that is running through the supporting mechanism U1, e.g., scale generated during heat treatment, will be discharged. Further, between the lateral members 14, i.e., between the edges of them, are openings 19. Therefore, the foreign material such as the dust or the fouling that is discharged from the supporting mechanism U1 will be discharged from the supporting unit U through the openings 19. Accordingly, the supporting unit U will not accumulate any foreign material in it through the openings 19.

Preferably, piping portions 20 are provided so as to introduce the gas such as compressed air into the supporting unit U. The number of piping portions 20 may be appropriately chosen. But in this embodiment, they are provided on the four lateral members 14. The piping portions 20 are fit with nozzles of a gas supply unit. The gas is supplied to the supporting mechanism U1 in the supporting unit U through the piping portions 20. Thus the supporting mechanism U1 and the inside of the supporting unit U may be kept clean.

In the supporting mechanism U1 of this embodiment the coil spring 2 is used as a biasing means. But a cylindrical elastic body, a flat spring, a conical disc spring, etc., may be used for this means.

In this embodiment, four rectangular plates are used as the lateral members 14, because the member for the inserting side 11 and the member for the outgoing side 13 are both rectangular. However, if the member for the inserting side 11 and the member for the outgoing side 13 are circular discs, one hollow cylinder may be used as a lateral member 14. Namely, in the present invention, the member for the inserting side and the member for the outgoing side may be formed in a quadrangular, circular, elliptical, or polygonal shape. The shape of the lateral member may be appropriately chosen, as long as it corresponds to that of the member for the inserting side and the member for the outgoing side.

A bolt 15 is used for an affixing means. But in the present invention that means is not restricted to it. A press-in pin, a welding means, an adhesive agent, or a screw means, especially for the lateral member, may be used for the affixing means. Using bolts 15 makes it easy to disassemble and reassemble the unit during maintenance.

In this embodiment, the openings 19 are provided on all four portions of the edges of the lateral members 14 that are adjacent to each other. So the supporting unit U can be set in any position as long as it is provided at a position to be installed inside the device for processing, i.e., so that an incorrect installation of the supporting unit U can be avoided and any foreign materials can be discharged. However, the supporting unit U may have at least one opening 19, if it is specified that the position of the supporting unit U should be set at the position to be installed inside a device for processing in order that the opening 19 should be at the under side. Accordingly, in the present invention, the opening may be made at an appropriate part of the lateral member, if only the foreign materials in the supporting unit U are able to be discharged. In this embodiment, since four lateral members are used, at least one opening may be made between an adjacent pair of them.

A die 12*a* and a die 12*b*, both of which are shaped as truncated cones, are respectively fixed at the entrance 11*a* of the member for the inserting side 11 and the exit 13*a* of the member for the outgoing side 13, by bolts 21. In the present invention, the construction of them is not restricted to this. Namely, the dies 12*a* and 12*b* may be respectively provided on the outer surfaces of the member for the inserting side 11 and the member for the outgoing side 13.

Figure 5:
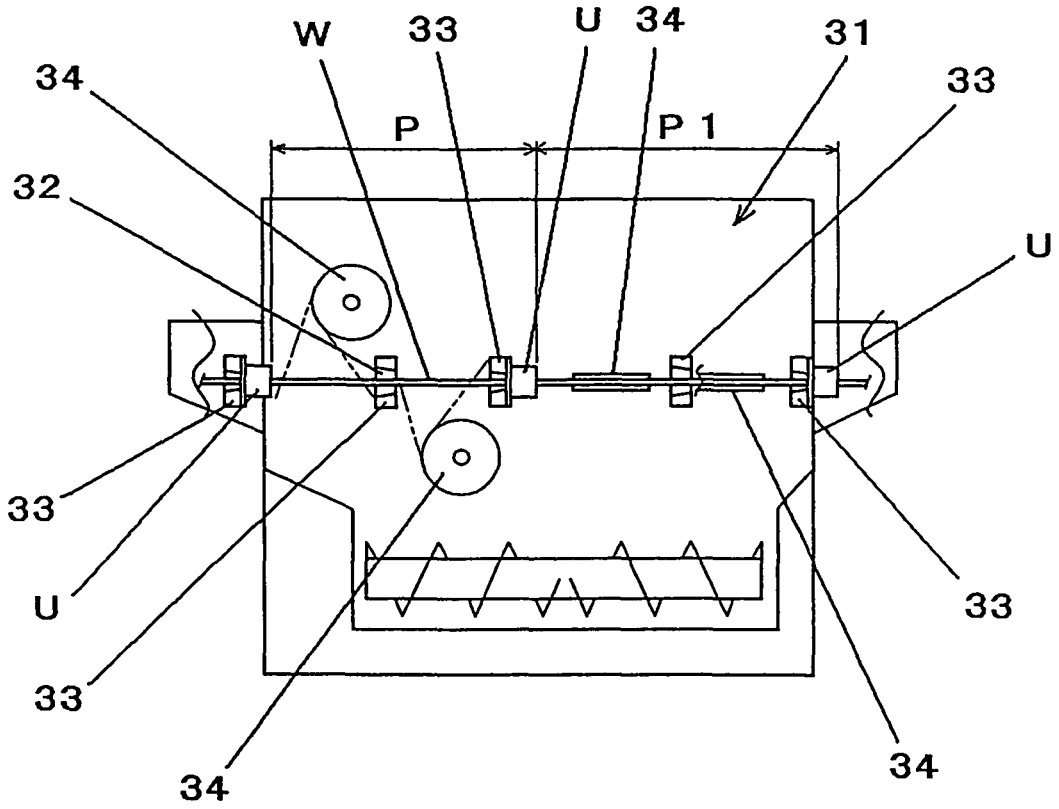
FIG. 5 is a partially sectional view of a shot-blasting device to which the present invention is applied.

FIG. 5 shows an example that applies the supporting unit U to a shot-blasting device, where the device acts as a device for processing. This shot-blasting device comprises a feeding device of a long piece of material (not shown), a plurality of guiding members 33, four throwing devices 34, and a winding device (not shown). The feeding device of a long piece of material is installed on the entry side of the polishing chamber 31, for the long piece of material W, that is used as a processing chamber. The device makes the long piece of material W, which has been wound into a coil, in a straight line, and then feeds it to the chamber. The guiding members 33 are installed on the long piece of material W at the entrance and at the exit of the polishing chamber 31, as well as on it at the middle of the chamber 31, with a required distance between them in a horizontal direction, and each of these has a tapered through-hole 32. The throwing devices 34 are installed in the polishing chamber 31. They throw shot-blasting media against the long piece of material W that is pulled out of the feeding device of a long piece of material and that is running in the chamber. The winding device is installed on the exit side of the polishing chamber. It winds the long piece of material W to which the shot-blasting media has been thrown from the throwing devices.

In this shot-blasting device, the supporting units U are fixed on the guiding members 33 that are installed on the long piece of material W at the entrance and the exit of the polishing chamber 31 and at the middle of it. The distances P and P1 between supporting units U may be 1000-1500 mm, as shown by the result in an experiment. Preferably, their length should be set at 1000-1100 mm. This length has proven to be able to restrict the swing of a long piece of material.

What is claimed is:

1. A supporting unit for a long piece of material comprising:

a casing having an entrance and an exit through which a long piece of material is inserted, said casing comprising a member for an inserting side of the casing that has the entrance, a member for an outgoing side that is placed at an opposite side of the casing, from the member for the inserting side and has the exit, lateral members that enclose the space between the member for the inserting side and the member for the outgoing side, liners attached to an inner surface of each of the lateral members; each of said liners having openings, and affixing means that fix the member for the inserting side, the member for the outgoing side, and the lateral members; and a supporting mechanism for the long piece of material installed in the casing, said supporting mechanism comprising:

a group of spherical bodies that is provided around a central axis of the long piece of material, a plurality of movable supporting members that are provided around the group of spherical bodies and having surfaces that contact a periphery of the group, and a plurality of biasing means that push each of the movable supporting members toward the central axis of the long piece of material, wherein the biasing means are coil springs and wherein back surfaces of the moveable supporting members, opposite from the surfaces that contact the periphery of the group of spherical bodies, have concave portions in which are mounted one end of the coil springs, and wherein opposite ends of the coil springs pass through said openings in the liners and are mounted on the inner surfaces of each of the lateral members.

2. The supporting unit for a long piece of material of claim 1, wherein the group of sperical bodies comprises a first group of spherical bodies, and a second group of spherical bodies that is circumferentially provided around the first group of spherical bodies.

3. The supporting unit of claim 1, wherein bolts are inserted from the lateral members to the concave portions of the moveable supporting members that restrict movement of the movable supporting members.

4. The supporting unit of claim 1, wherein dies are provided on the entrance of the member for the inserting side and the exit of the member for the outgoing side.

5. The supporting unit of claim 1, wherein the lateral members have openings at predetermined positions.

6. A method for preventing swings of a long piece of material comprising placing one or more supporting units of claim 1 along a path of movement of the material in a device for processing the material.

* * * * *